US007251838B1

(12) United States Patent
Rumbaugh et al.

(10) Patent No.: US 7,251,838 B1
(45) Date of Patent: Aug. 7, 2007

(54) CHEERING SYSTEM

(76) Inventors: Christopher L. Rumbaugh, 117 Hidden Oak Dr., Mars, PA (US) 16046; Jennifer L. Rumbaugh, 117 Hidden Oak Dr., Mars, PA (US) 16046

( * ) Notice: Subject to any disclaimer, the term of this patent is extended or adjusted under 35 U.S.C. 154(b) by 0 days.

(21) Appl. No.: 11/388,138

(22) Filed: Mar. 24, 2006

(51) Int. Cl.
*A41D 19/00* (2006.01)

(52) U.S. Cl. ..... 2/160; 2/159; 2/161.1

(58) Field of Classification Search ..... 2/160, 2/161.1; 446/26, 327, 328, 390
See application file for complete search history.

(56) References Cited

U.S. PATENT DOCUMENTS 2,103,594 A 12/1937 Murray
D169,026 S 3/1953 Baray
2,783,759 A * 3/1957 Hill ..... 128/879
3,847,110 A * 11/1974 Inoue ..... 116/223
4,369,215 A 1/1983 Offen et al.
4,543,671 A * 10/1985 Monk ..... 2/158
4,757,558 A 7/1988 Strongwater
5,079,046 A * 1/1992 Kessler ..... 428/4
5,152,532 A * 10/1992 Rouse ..... 473/213
5,234,725 A 8/1993 Smith
5,962,086 A 10/1999 Offen
6,112,330 A * 9/2000 Bryan ..... 2/160
6,340,507 B2 1/2002 Holguin

* cited by examiner

*Primary Examiner*—Katherine Moran
*Assistant Examiner*—Sally Colson Cline

(57) ABSTRACT

A cheering system includes a glove including a palm covering, a back hand covering and a plurality of finger receiving members. A plurality of cheering devices is provided. Each of the cheering devices has a panel attached thereto. A coupler is configured for removably coupling one of the panels of the cheering devices to an outer surface of the back hand covering.

4 Claims, 5 Drawing Sheets

CHEERING SYSTEM

BACKGROUND OF THE INVENTION

1. Field of the Invention

The present invention relates to cheering devices that include pompoms, as towels, mascots, bells and other assorted cheerleading devices, and more particularly pertains to a new cheering device for attaching a pompom to a person's hand in such a manner that the person's hands are free for gripping other items, clapping, performing stunts or for other purposes, and also allows the wearer of the cheering devices to selectively couple various types of pompoms or cheering devices to their hands.

2. Description of the Prior Art

The use of pompom devices is known in the prior art. U.S. Pat. No. 5,234,725 describes a device that may be worn on the wrists of a cheerleader. Another type of pompom device is U.S. Pat. No. 6,340,507 having a configuration allowing it to be removably attached to a selected body part. A more conventional pompon construction is shown in U.S. Pat. No. 5,079,046.

While these devices fulfill their respective, particular objectives and requirements, the need remains for a device that allows a person to wear cheering devices on the backs of their hands so that their hands are free during cheerleading activities. Further, the device should be configured to allow selective removal and attachment of different types of cheering devices to the hands without having to remove the complete device from the hands.

SUMMARY OF THE INVENTION

The present invention meets the needs presented above by generally comprising a glove including a palm covering, a back hand covering and a plurality of finger receiving members. A plurality of cheering devices is provided. Each of the cheering devices has a panel attached thereto. A coupler is configured for removably coupling one of the panels of the cheering devices to an outer surface of the back hand covering.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
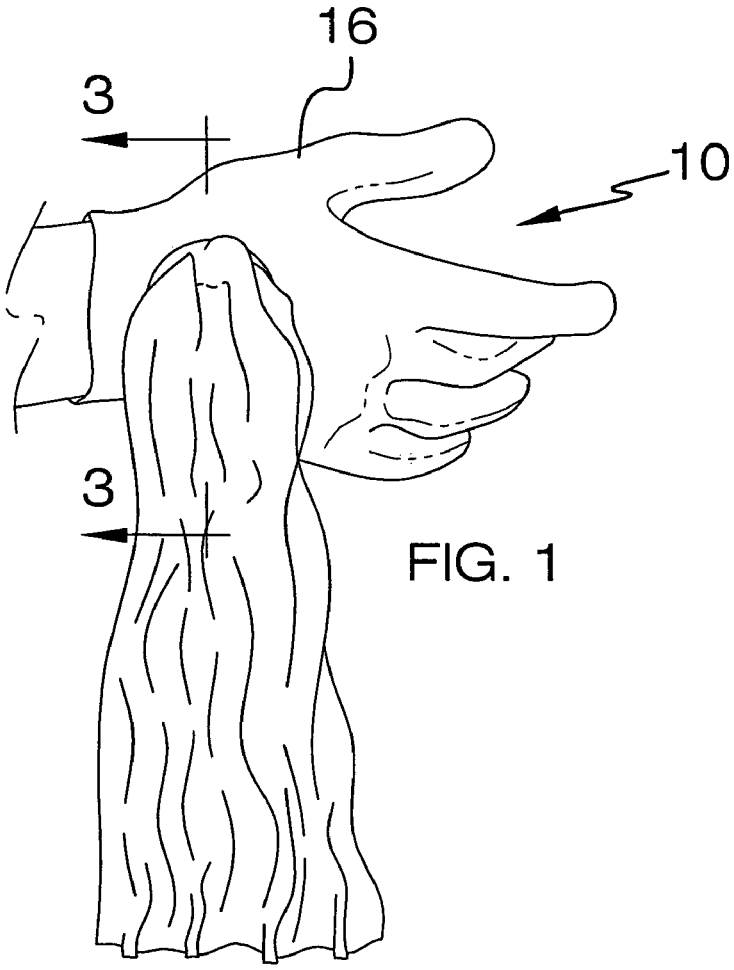
FIG. 1 is a front view of a cheering system according to the present invention.
Figure 2:
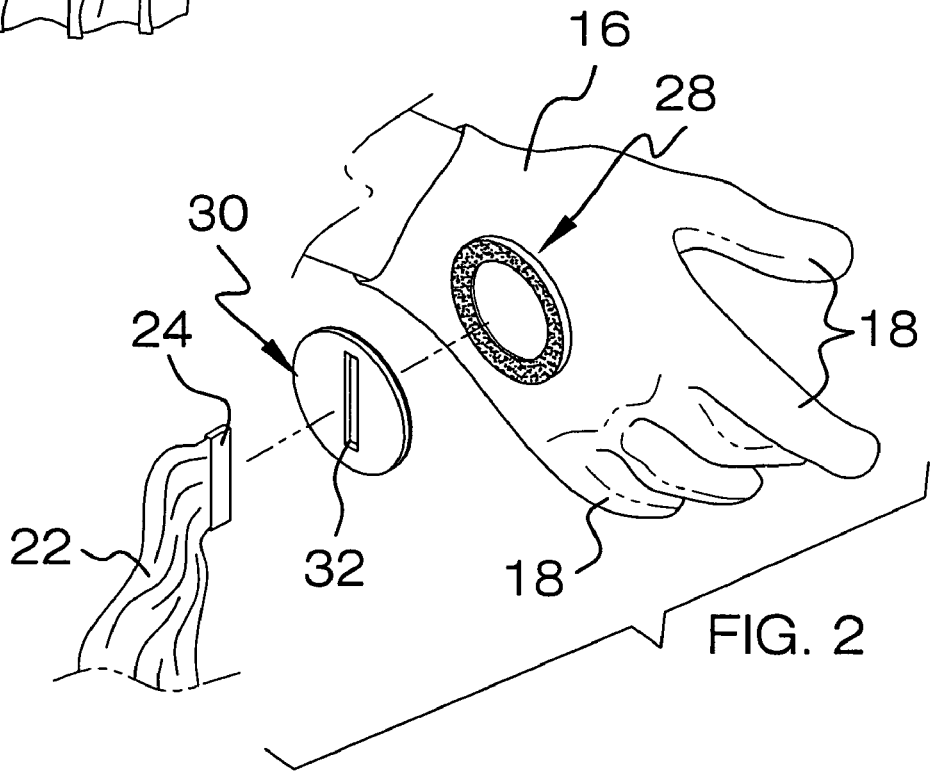
FIG. 2 is an exploded perspective view of the present invention.
Figure 3:
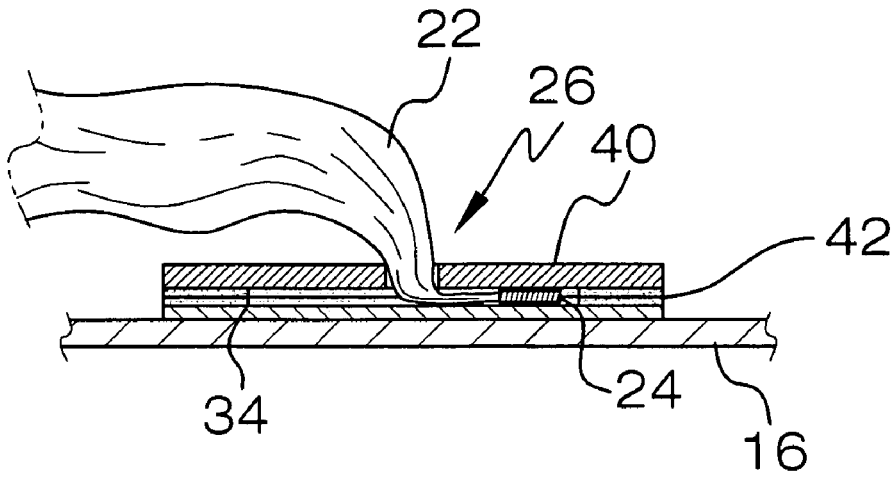
FIG. 3 is a cross-sectional view taken along line 3-3 of FIG. 1 of the present invention.
Figure 4:
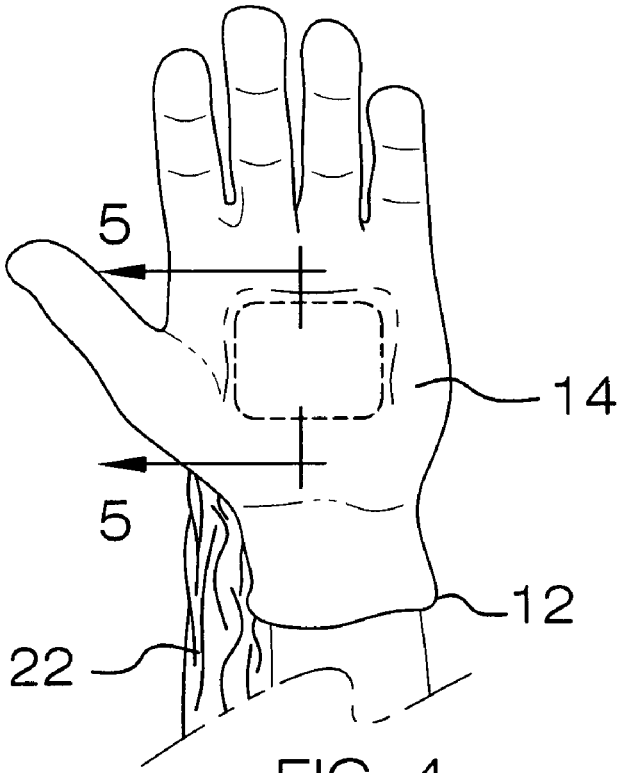
FIG. 4 is a back view of the present invention.
Figure 5:
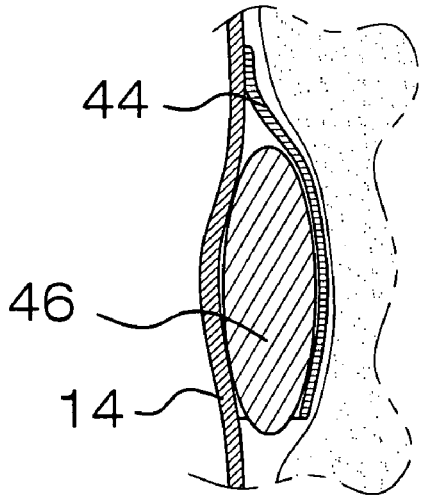
FIG. 5 is a cross-sectional view taken along line 5-5 of FIG. 4 of the present invention.

With reference now to the drawings, and in particular to FIGS. 1 through 9 thereof, a new cheering system embodying the principles and concepts of the present invention and generally designated by the reference numeral 10 will be described.

Figure 6:
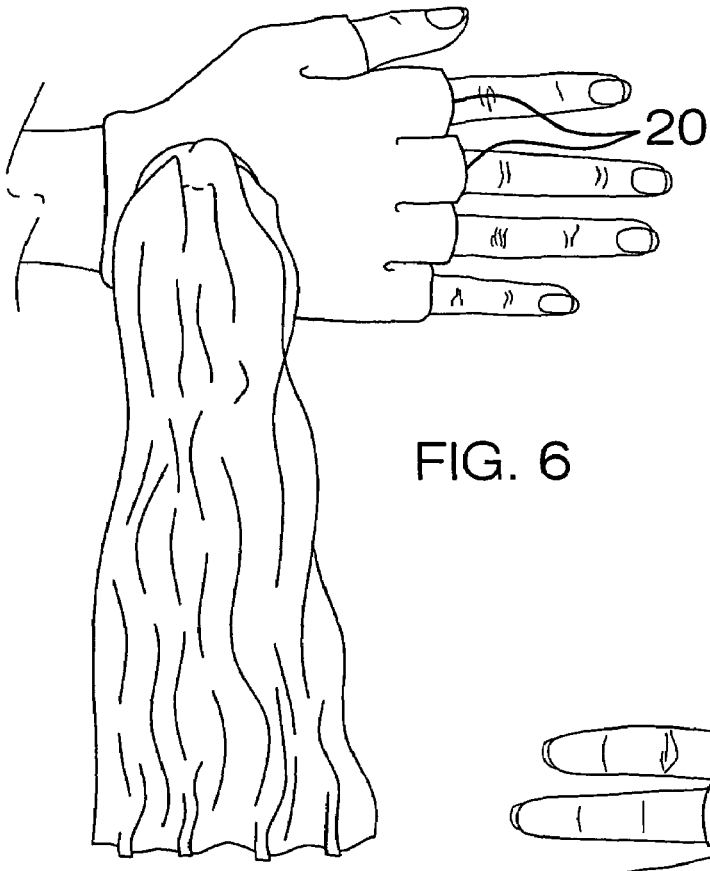
FIG. 6 is a front view of a second embodiment of the present invention.
Figure 7:
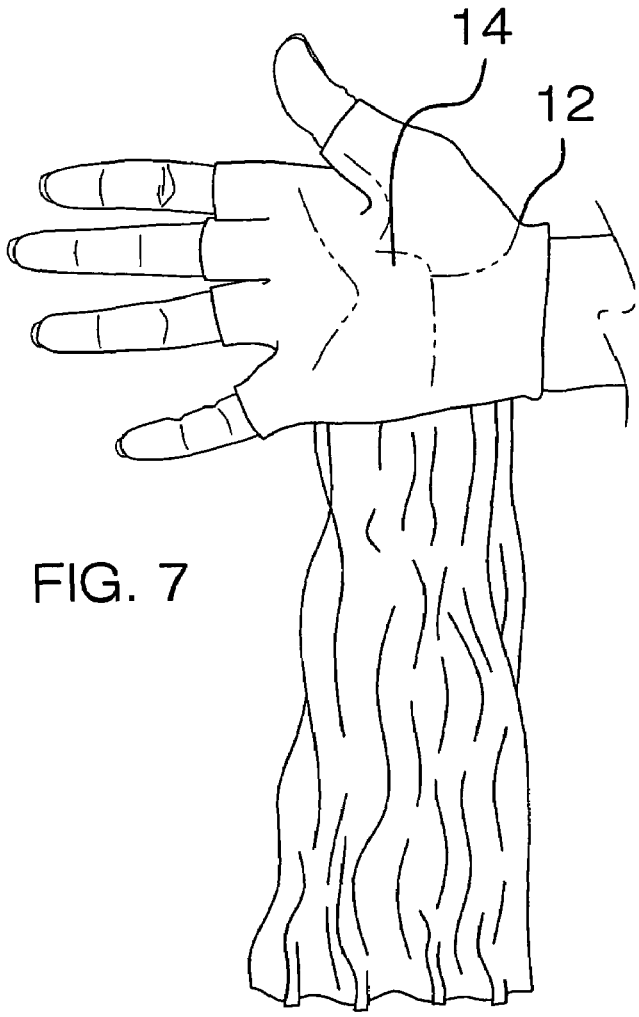
FIG. 7 is a back view of the second embodiment of the present invention.
Figure 8:
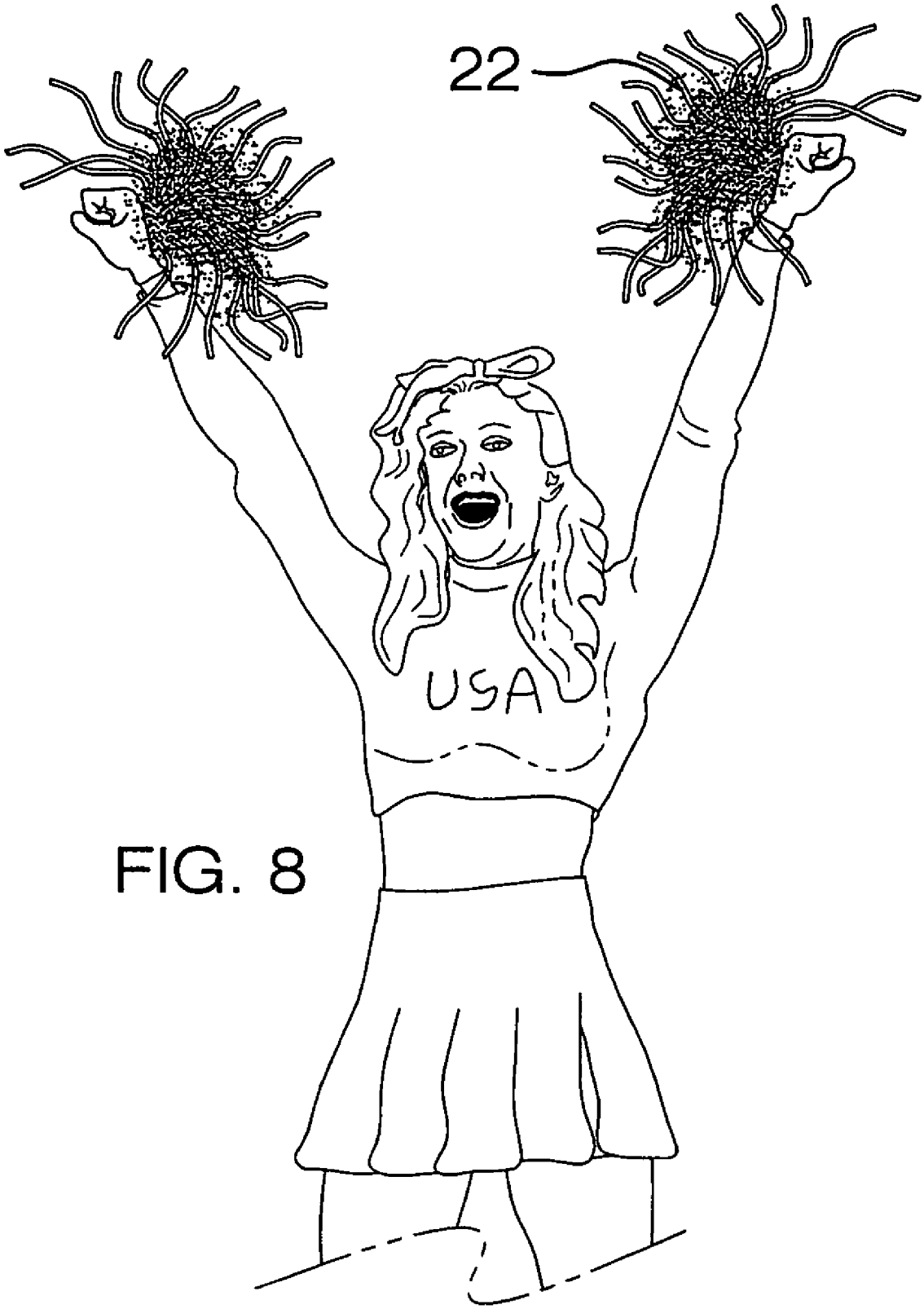
FIG. 8 is an in-use view of the present invention.
Figure 9:
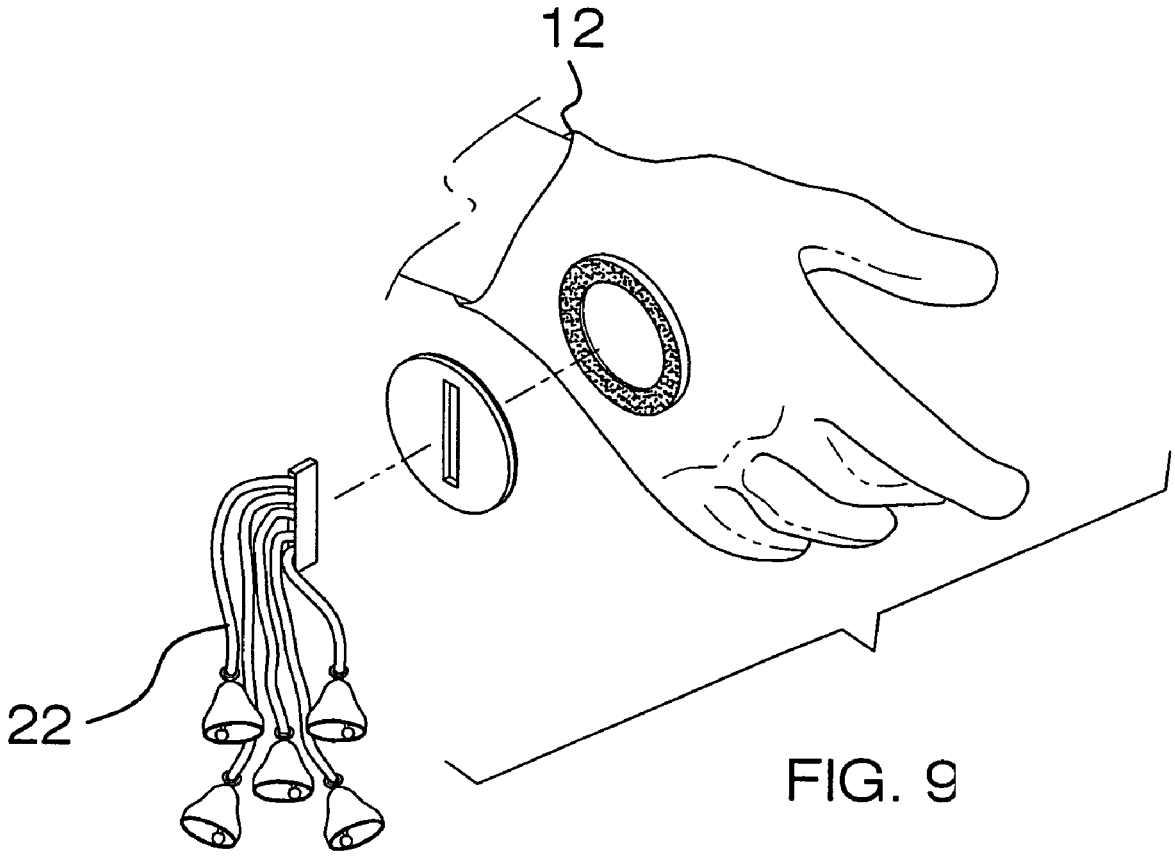
FIG. 9 is a front view of a pompom variation of the present invention.

As best illustrated in FIGS. 1 through 9, the cheering system 10 generally comprises a glove 12 having a generally conventional structure and including a palm covering 14, a back hand covering 16 and a plurality of finger receiving members 18. FIGS. 6 and 7 show finger receiving members 18 having open ends 20 for allowing the passage of fingers therethrough.

A plurality of cheering devices 22 is provided. Each of the cheering devices 22 has a panel 24 attached thereto. The plurality of cheering devices 22 includes a definition of pompoms not only including traditional pompom constructions but pompoms 22 having different constructions. The constructions include such items as tassels, feathers, flexible panels, tethered bells, streamers, small mascots, and any other such device often used by a cheerleader.

A coupler 26 is configured for removably coupling one of the panels 24 of the cheering devices 22 to an outer surface of the back hand covering 16. The coupler 26 includes a first coupling portion 28 that is attached to the outer surface. A second coupling portion 30 is removably couplable to the first coupling portion 28. The second coupling portion 30 has an elongated slit 32 extending therethrough. One of the panels 24 of the plurality of cheering devices 22 is removably extendable through the slit 32. More particularly, the first coupling portion 28 includes a base wall 34 attached to the back hand covering 16. The second coupling portion 30 includes a plate 40. The coupler 26 further including hook and loop mating sections 42 attached to and releasably securing together the first and second coupling portions. One of mating sections of the hook and loop mating sections 42 is positioned on the base wall 34 and the other is positioned on the plate 40.

A pocket 44 is positioned in the glove 12. The pocket 44 is attached to an inner surface of the palm covering 14. A heating pad 46 is removably positioned in the pocket 44 to keep the hand of a wearer of the glove 12 warm.

In use, a person would normally use one or two gloves 12 and would secure selected cheering devices 22 to the gloves 12. The user may decide which construction would be appropriate for a particular event or type of cheer. The hands of the person wearing the gloves 12 would be free for performing stunts and cheers. The heating pad 46 may be used as needed during cold weather.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A cheering assembly comprising:

a glove including a palm covering, a back hand covering and a plurality of finger receiving members;

a plurality of cheering devices, each of said cheering devices having a panel attached thereto; and a coupler being configured for removably coupling one of said panels of said cheering devices to an outer surface of said back hand covering, said coupler including;

a first coupling portion being attached to said outer surface; and a second coupling portion being removably couplable to said first coupling portion, said second coupling portion having an elongated slit extending therethrough, one of said panels of said plurality of cheering devices being removably extendable through said slit.

2. The assembly according to claim 1, wherein said coupler includes hook and loop mating sections attached to and releasably securing together said first and second coupling portions.

3. The assembly according to claim 1, further including a pocket being positioned in said glove, said pocket being attached to an inner surface of said palm covering, a heating pad being removably positioned in said pocket.

4. A cheering assembly comprising:

a glove including a palm covering, a back hand covering and a plurality of finger receiving members;

a plurality of cheering devices, each of said cheering devices having a panel attached thereto;

a coupler being configured for removably coupling one of said panels of said cheering devices to an outer surface of said back hand covering, said coupler including;

a first coupling portion being attached to said outer surface;

a second coupling portion being removably couplable to said first coupling portion, said second coupling portion having an elongated slit extending therethrough, one of said panels of said plurality of cheering devices being removably extendable through said slit;

hook and loop mating sections attached to and releasably securing together said first and second coupling portions;

a pocket being positioned in said glove, said pocket being attached to an inner surface of said palm covering;

a heating pad being removably positioned in said pocket.

* * * * *